US005285994A

United States Patent [19]

Wang

[11] Patent Number: 5,285,994

[45] Date of Patent: Feb. 15, 1994

[54] WALL MOUNTING SUPPORT

[76] Inventor: Wen-Mu Wang, No. 32, Lane 266, Fu Te I Rd., Hsi Tze Chen, Taipei Hsien, Taiwan

[21] Appl. No.: 885,887

[22] Filed: May 20, 1992

[51] Int. Cl.[5] ..... A47G 1/16

[52] U.S. Cl. ..... 248/477; 248/488

[58] Field of Search ..... 248/475.1, 477, 488, 248/486

[56] References Cited

U.S. PATENT DOCUMENTS

| | | | |
|---|---|---|---|
| 2,532,162 | 11/1950 | Goss | 248/488 |
| 3,049,323 | 8/1962 | Peterka | 248/488 |
| 4,217,710 | 8/1980 | Becker | 248/488 |

FOREIGN PATENT DOCUMENTS

| | | | |
|---|---|---|---|
| 2642953 | 8/1990 | France | 248/475.1 |

*Primary Examiner*—Hien H. Phan

*Attorney, Agent, or Firm*—Varndell Legal Group

[57] ABSTRACT

A wall mounting support includes a shell fastened to a wall by an anchor and a screw, the shell comprising a front guard spaced from a front wall thereof with a receiving chamber defined therebetween for receiving the object to be supported. The front wall includes two resilient corrugated locating plates bilaterally obliquely disposed in an elongated opening of the front wall with a narrow sliding hole defined therebetween for permitting the screw head of the screw to be located at different symmetrical pairs of depressions on the corrugated locating plates.

2 Claims, 4 Drawing Sheets

WALL MOUNTING SUPPORT

BACKGROUND AND SUMMARY OF THE INVENTION

The present invention relates to a wall mounting support, and more particularly the present invention relates to a wall mounting support to he fastened to a flat wall in supporting a picture frame or the like.

FIG. 1 illustrates a prior art wall mounting support to be used in supporting a picture frame or the like on a wall. This wall mounting support is generally comprised of a base which has two pin holes and a through hole, an intermediate plate which has a bolt hole aligned with the through hole on the base and two pins respectively inserted into the two pin holes on the base, and a cover covering the intermediate plate. By fastening an anchor in a hole on a wall and threading a screw into the bolt hole on the intermediate plate, the through hole on the base and a hole on the anchor, the base and the intermediate plate are fastened to the wall. When fastened, a groove is defined between the base and the intermediate plate, which receives the object to be supported. This structure of a wall mounting support is consisted of three separate parts, and therefore it is relatively expensive to manufacture and complicated to assemble. Another disadvantage of this structure of a wall mounting support is that the anchor must be fastened into the wall at a precise location, any small error may cause the object, which is supported on the wall mounting support, to become unstable.

The present invention has been accomplished to eliminate the aforesaid disadvantages. It is therefore an object of the present invention to provide a wall mounting support which is simple in structure and inexpensive to manufacture. It is another object of the present invention to provide a wall mounting support which can be adjusted after having fastened to a wall, so as to tightly hold the object supported thereon.

According to the preferred embodiment of the present invention, a wall mounting support comprises a shell fastened to a wall by an anchor and a screw. The shell comprises a front guard spaced from a front wall thereof with a receiving chamber defined therebetween for receiving the object to be supported, which front wall comprises two resilient corrugated locating plates bilaterally obliquely disposed in an elongated opening thereof with a narrow sliding hole defined therebetween for sliding the screw. This permits the screw head of the screw to be located at either symmetrical pairs of hollows or depression on the corrugated locating plates. Locating the screw head of the screw at the hollows or depressions on the locating plates at one end causes the shell to be firmly secured to the wall; locating the screw head of the screw at the hollows or depressions on the locating plates at an opposite end causes the shell to be loosely secured to the wall, permitting the shell to be rotated for changing the angle position of the receiving chamber.

DETAILED DESCRIPTION OF THE PREFERRED EMBODIMENT

Figure 1:
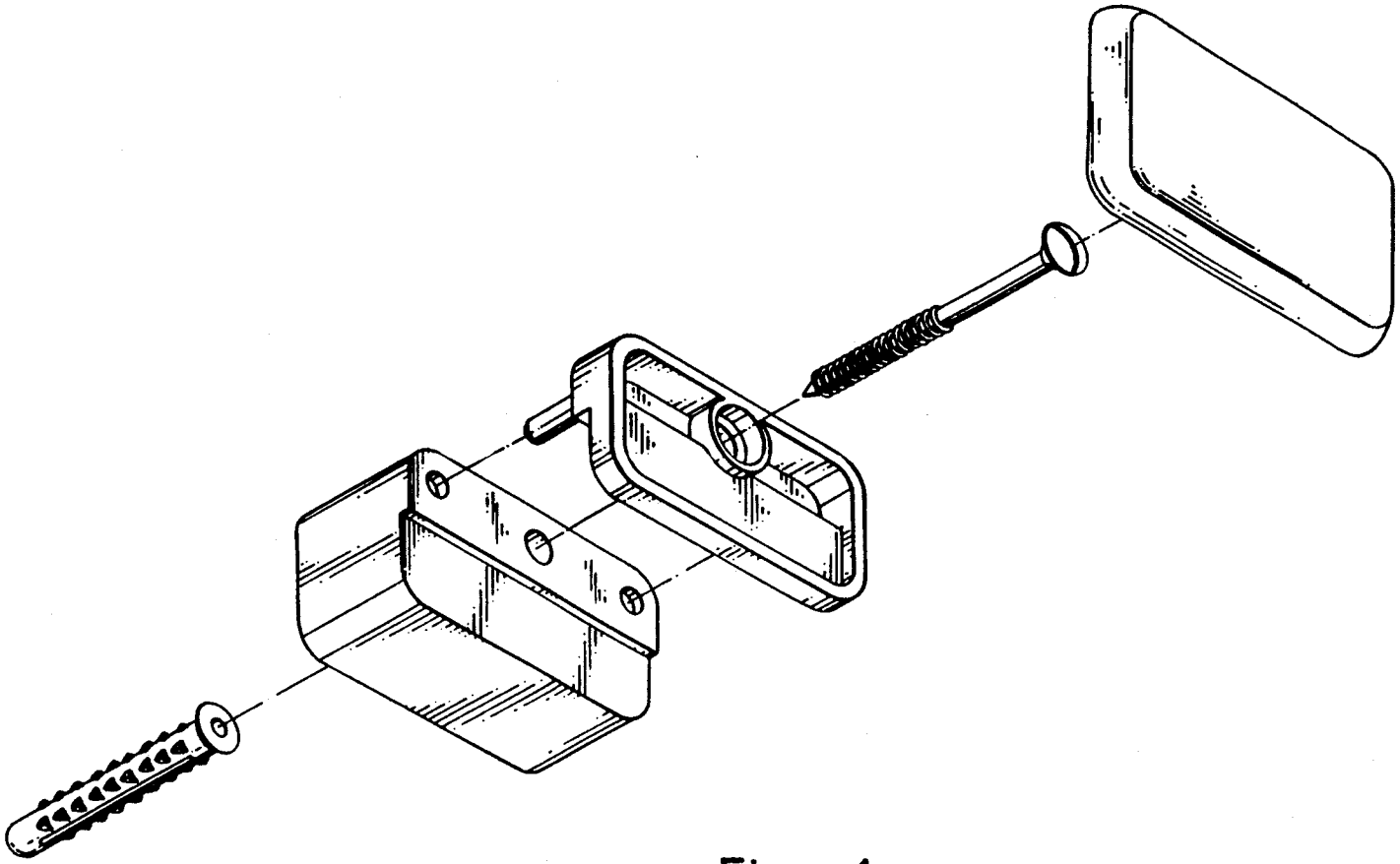
Fig. 1 PRIOR ART
FIG. 1 is an exploded view of a prior art wall mounting support.
Figure 2:
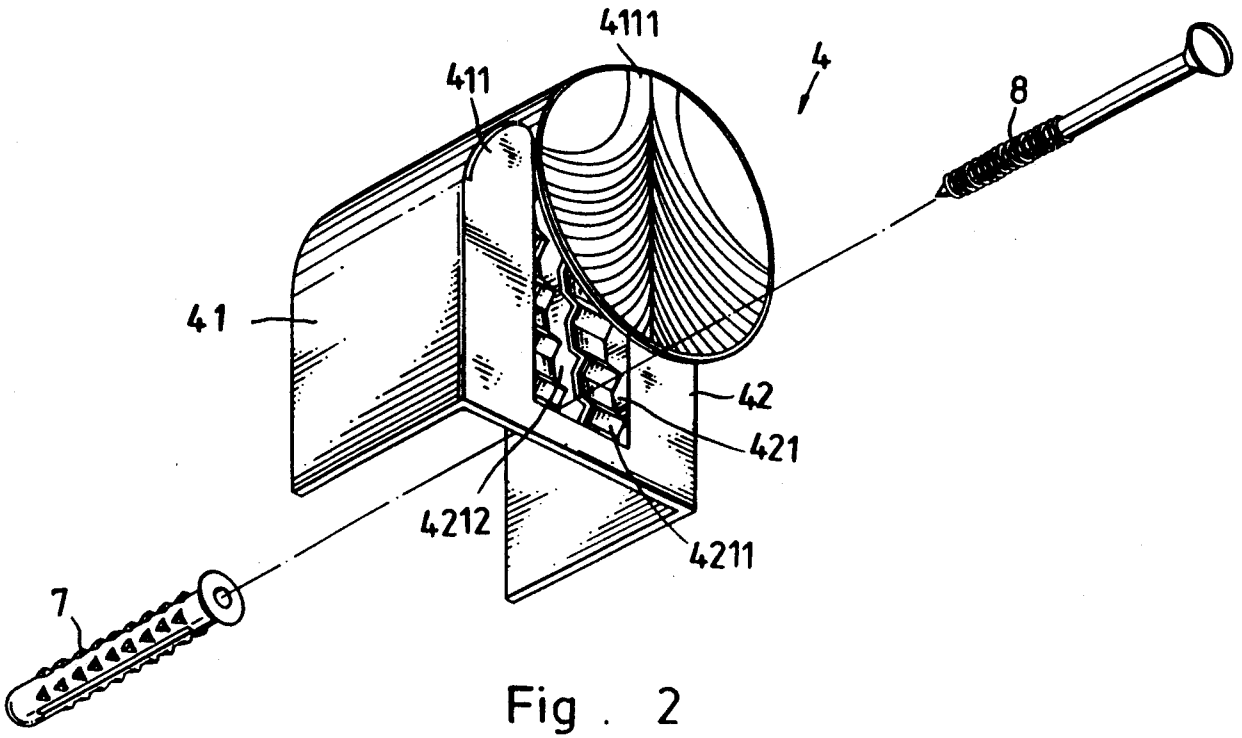
FIG. 2 is an exploded view of the preferred embodiment of the wall mounting support of the present invention.
Figure 3:
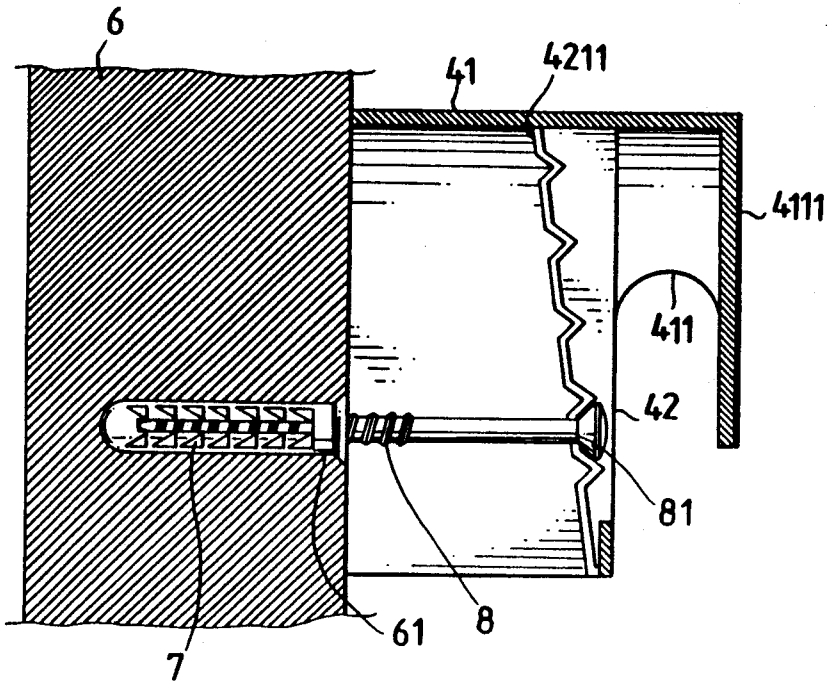
FIG. 3 is a sectional view showing that the wall mounting support of the present invention has been fastened to the wall.

Referring to FIGS. 1 and 2, a wall mounting support 4 as constructed in accordance with the present invention is generally comprised of a shell 41 having a front guard 4111 spaced from the front wall 42 thereof with a receiving chamber 411 defined therebetween, which receiving chamber 411 is to receive the picture frame or the like to be held. There are two unitary corrugated locating plate 4211 bilaterally obliquely disposed in an elongated opening 421 on the front wall 42 of the shell 41 with an elongated sliding hole 4212 obliquely defined therebetween for inserting a screw 8. The corrugated locating plates 4211 have each a higher end disposed out of the covering area of the front guard and connected to the top edge of the front wall 42, and a lower end covered by the front guard 4111 and spaced from the top edge of the front wall 42. The corrugated locating plate 4211 are each shaped into straight parallel regular and equally curved ridges and hollows (or depressions). The height of the front guard 4111 is relatively lower than the height of the front wall 42, and the width of the elongated sliding hole 4212 is approximately equal to the outer diameter of the screw to be inserted. By fastening an anchor 7 in a hole 61 on a wall 6, the shell 41 can be connected to the wall 6 and secured to the anchor 7 by a screw 8. As soon as the screw 8 has been threaded through the elongated sliding hole 4212 into the anchor 7, the head 81 of the screw 8 is stopped at either symmetrical pair of hollows on the two corrugated locating plates 4211 (see FIG. 3). In the present preferred embodiment, the shell 41 is made from an elastic resilient material through the process of injection molding, therefore, the material property permits the shell 41 to be moved relative to the screw 8, after it has been fastened to the wall 6 and secured to the anchor 7. Therefore, by changing the positioning of the expanded head 81 of the screw 8 on either symmetrical pair of hollows on the two corrugated locating plates 4211, the tightness of the shell 41 to the wall 6 and its position on the screw 8 are simultaneously changed. By locating the expanded head 81 of the screw 8 on the hollows near the lower ends of the corrugated locating plates 4211, the shell 41 can be rotated on the screw 8, and therefore the receiving chamber 411 can be turned to any desired angle.

Figure 4:
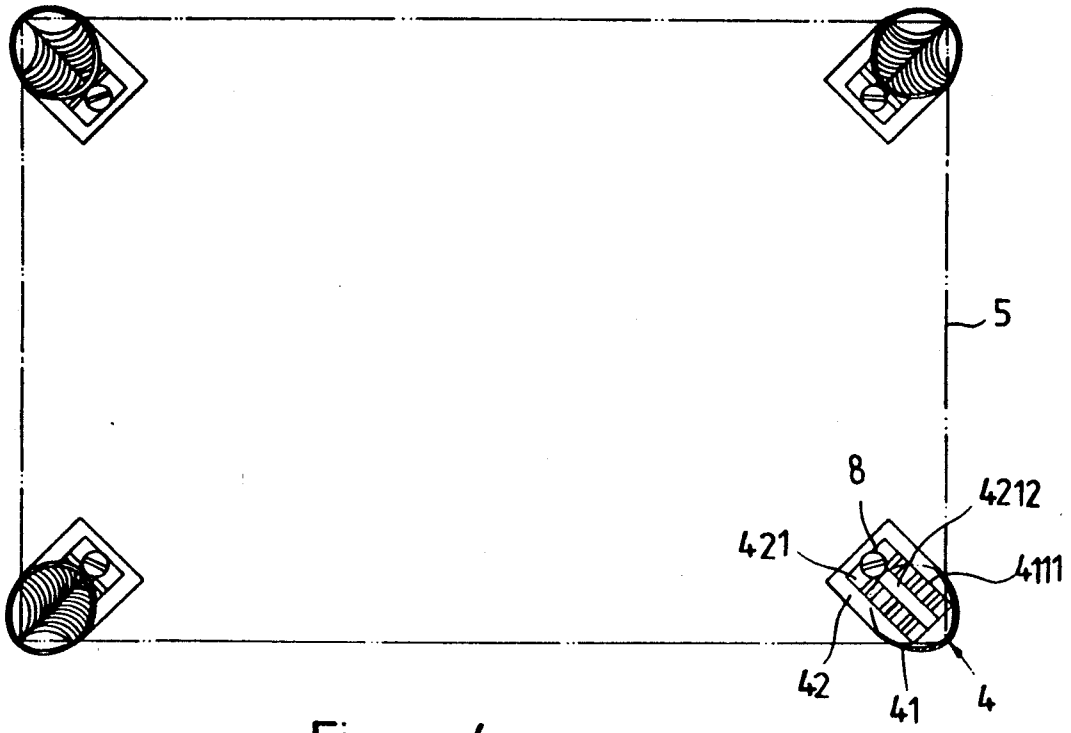
FIG. 4 is a plain view showing an application of the present invention in holding a rectangular mirror.

Referring to FIG. 4, therein illustrated is an application example of the present invention in holding a rectangular mirror 5. By fastening four pieces of casings 41 on a wall at four locations and adjusting their angle positions, the four corners of the rectangular mirror 5 are respectively received in the receiving chamber 411 in each shell 41.

It will be obvious to those skilled in the art that various changes may be made without departing from the scope of the invention and the invention is not to be considered limited to what is shown in the drawings and described in the specification. For example, reinforcing ribs may be formed on the shell 41 at suitable locations to strengthen its structural strength, or the front guard 4111 may be designed into an ornamental figure or the like.

I claim:

1. A wall mounting support comprising a shell fastened to a wall by an anchor and a screw, said shell including a front wall, a front guard spaced from said front wall, and a receiving chamber formed between said front wall and said front guard; said receiving chamber receiving an object to be supported, said front wall including an elongated opening with two resilient locating plates bilaterally and obliquely arranged therein, said two locating plates arranged with an elongated sliding hole therebetween and respectively having a corrugated surface with an identical pattern of shaped ridges and depressions, said screw passing through said elongated sliding hole and inserted into said anchor with a head of said screw head abutting one of said depressions of each said locating plate.

2. The wall mounting support according to claim 1, wherein said front guard has a front face made with ornamental patterns.

* * * * *